US010525370B1

(12) United States Patent
Poteet et al.

(10) Patent No.: US 10,525,370 B1
(45) Date of Patent: Jan. 7, 2020

(54) SYSTEM FOR OPERATING A MOTOR VEHICLE

(71) Applicant: Traxxas LP, McKinney, TX (US)

(72) Inventors: Kent Poteet, Lucas, TX (US); Brent W. Byers, Plano, TX (US); Gary M. DeWitt, Plano, TX (US)

(73) Assignee: TRAXXAS LP, McKinney, TX (US)

( * ) Notice: Subject to any disclaimer, the term of this patent is extended or adjusted under 35 U.S.C. 154(b) by 312 days.

(21) Appl. No.: 13/855,622

(22) Filed: Apr. 2, 2013

Related U.S. Application Data

(60) Provisional application No. 61/619,383, filed on Apr. 2, 2012.

(51) Int. Cl.
*A63H 30/04* (2006.01)

(52) U.S. Cl.
CPC ..... *A63H 30/04* (2013.01)

(58) Field of Classification Search
CPC ..... A63H 30/04
See application file for complete search history.

(56) References Cited

U.S. PATENT DOCUMENTS 3,995,579 A * 12/1976 Childre ..... B63H 20/007 440/7
5,350,982 A * 9/1994 Seib ..... B60L 11/1805 280/DIG. 5
6,287,167 B1 9/2001 Kondo
8,282,440 B2 10/2012 Jenkins et al.
2002/0187726 A1 12/2002 Yamaguchi
2003/0067287 A1* 4/2003 Morgen ..... 323/273
2003/0114075 A1 6/2003 Moll et al.
2004/0065489 A1* 4/2004 Aberle et al. ..... 180/65.1
2004/0204816 A1* 10/2004 Dery ..... 701/113
2011/0071705 A1* 3/2011 Matuszeski ..... B64C 39/024 701/3
2013/0012080 A1* 1/2013 Yoshikawa ..... B63H 21/213 440/1

FOREIGN PATENT DOCUMENTS

JP 2000-051540 A 2/2000

OTHER PUBLICATIONS

Traxxas; E-Maxx Owners Manual—Model 3906;Traxas; 2002.
Unknown; Jumpers; 2004 PCGuide, available at <http://pcguide.com/into/fun/jump.htm>.
Novak; Super Sport Instruction Manual; Novak Electronics, Inc.; U.S.A. Feb. 2003.
Novak; Profile Selection & Proper Gearing; Novak Electronics, Inc.; U.S.A. Feb 2005.

(Continued)

*Primary Examiner* — Mary Cheung
(74) *Attorney, Agent, or Firm* — Daryl R. Wright; Greg Carr

(57) ABSTRACT

A motor controller receives user input from a receiver and may change the operating mode of the motor controller according to the operating conditions of a model vehicle. In some embodiments, the user manually selects a mode of operation for the motor. In other embodiments, the operating conditions, for example the speed, power output, or other condition, may automatically trigger a transition between a first mode and a second mode of operation of the motor.

19 Claims, 9 Drawing Sheets

(56) References Cited

OTHER PUBLICATIONS

Traxxas; XL-1 Forward/Reverse Electronic Speed Control; Traxxas LP; Plano, Texas.
Traxxas; XL-10 Electronic Speed Control Instruction; Traxxas LP; Plano, Texas.
Product Design; Turbo Zeta Instruction Booklet; Product Design Inc.; Redmond, Washington.
Castle Creations; Mamba Max User Guide; Castle Creations, Inc.; Olathe, Kansas, 2006.
Castle Creations; Mamba-25 Instruction Sheet; Castle Creations, Inc.; Olathe, Kansas, 2004.
Castle Creations; Phoenix-60 Instruction Sheet; Castle Creations, Inc.; Olathe, Kansas, 2004.
Castle Creations; Castle Link USb Programming Kit Web Page; Castle Creations, Inc.; Olathe, Kansas, 2006.
Wikipedia; Castle Creations Article; Wikimedia Foundation, Inc.; http://en.wikipedia.org/wiki/Castle_Creations, Jul. 12, 2006.
Wikipedia; Wireless USB Article; Wikimedia Foundation, Inc.; http://en.wikipedia.org/wiki/Wireless_USB, Jul. 12, 2006.
Teamnovak.com; Techinical Info—Speed Control Terminology, What is Drive PWM Frequency?, What is Brake PWN Frequency?; http://www.teamnovak.com/tech_info/esc_termin/index.html; 2012.
Teamnovak.com; Techinical Info—Speed Control Application & Installation, What effect does changing teh Drive or Brake PWM frequency have?; http://www.teamnovak.com/tech_info/esc_applic/index.html; 2012.
Klejwa, Kevin; RC Groups.com; ESC Switching Frequency . . . high or low?; http://www.rcgroups.com/forums/showthread.php?t=29617, 2002.
Novak; E-Max Rooster Combo Operating Instructions; Novak Electronics , Inc.; 2001.
Traxxas; EVX Electronic Speed Control Installation/Operation Instruction; Traxxas LP; Plano, Texas, 2004.
Wikipedia; Electronic Speed Control article; Wikimedia Foundation, Inc.; http://en.wikipedia.org/wiki/Electronic_Speed_Control, Jul. 12, 2006.

* cited by examiner

SYSTEM FOR OPERATING A MOTOR VEHICLE

CROSS-REFERENCE TO RELATED APPLICATIONS

This application relates to, and claims the benefit of the filing date of, U.S. provisional patent application Ser. No. 61/619,383 entitled SYSTEM FOR OPERATING A MODEL VEHICLE, filed Apr. 2, 2012, the entire contents of which are incorporated herein by reference for all purposes.

FIELD OF THE INVENTION

This disclosure relates to systems and methods for driving model vehicles, and, more particularly, to a system for operating a remote controlled model vehicle.

DESCRIPTION OF THE RELATED ART

In traditional drag racing of full size vehicles (such as in the National Hot Rod Association), a drag race car will first warm up the tires by performing a "burnout." The driver of the drag race car will spin the rear tires causing them to heat up and soften, which maximizes tire grip.

Typically, staging is accomplished by moving the drag race car slowly, at a relatively low throttle so that the front tires of the drag race car are precisely positioned relative to two IR beams at the starting line. The driver will then "stage" the drag race car by positioning car at a racing starting line.

The driver will then engage a "Launch Control" system that allows the engine to be revved up and at a designed rotations per minute (rpm). When the race begins, the driver disengages the Launch Control to instantly launch the car down the track, and uses the throttle pedal to modulate power and stay on the edge of traction.

In drag racing a model vehicle, a drag race car model vehicle will use an electric motor, such as a direct current (DC) motor. A battery or similar power source is connected to the motor. The motor receives its power input from the battery, wherein the power input is normally managed by a means of throttle control. Power applied to a motor can be adjusted in different manners including adjustable currents and voltages. Conventional batteries are not adjustable with respect to voltage, and therefore the power output from these batteries is controlled by applying a chopped DC voltage at a duty cycle to the motor in response to the user's variable control of throttle input. Accordingly, if the user is applying maximum throttle to the model vehicle then voltage from the battery is controlled at a duty cycle to provide maximum power to the motor, enabling the model vehicle to travel at a top speed in a forward direction and/or a similar top speed in a reverse direction.

Controlling the motor by applying a chopped DC voltage at a duty cycle to the motor in response to the user's variable control of throttle input can cause significant problems during staging, even at a low relative power to the motor. Specifically, running the motor at even low throttle during staging prevents the user from having the precise control of the model vehicle drag race car. For instance, the model vehicle drag race car may operate at low speeds, e.g. 0-5 miles per hour, in a jerky or jumpy fashion taking relatively large lunges forward. With a powerful motor in a model vehicle a user may not be able to maintain sufficient precise control of the vehicle needed during staging to position the model vehicle at the starting line without experiencing repeated under-shoot and over shoot of the desired staging position. Such a problem exists whether the DC motor is a sensored or a sensorless motor.

A motor control mechanism and a user interface could provide advantages for a model vehicle drag race car by avoiding some of the drawbacks experienced during staging of a model vehicle drag race car described above. Accordingly, it would be one advantage over the prior art to enable a user to easily control motion of the motor of the model vehicle drag race car during staging.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

In the following discussion, numerous specific details are set forth to provide a thorough understanding of the present disclosure. However, those skilled in the art will appreciate that the claimed invention may be practiced without such specific details. In other instances, well-known elements have been illustrated in schematic or block diagram form in order not to obscure the present disclosure in unnecessary detail. Some of the descriptions in the present disclosure refer to hardware components, but as those skilled in the art will appreciate, these hardware components may be used in conjunction with hardware-implemented software and/or computer software.

Figure 1:
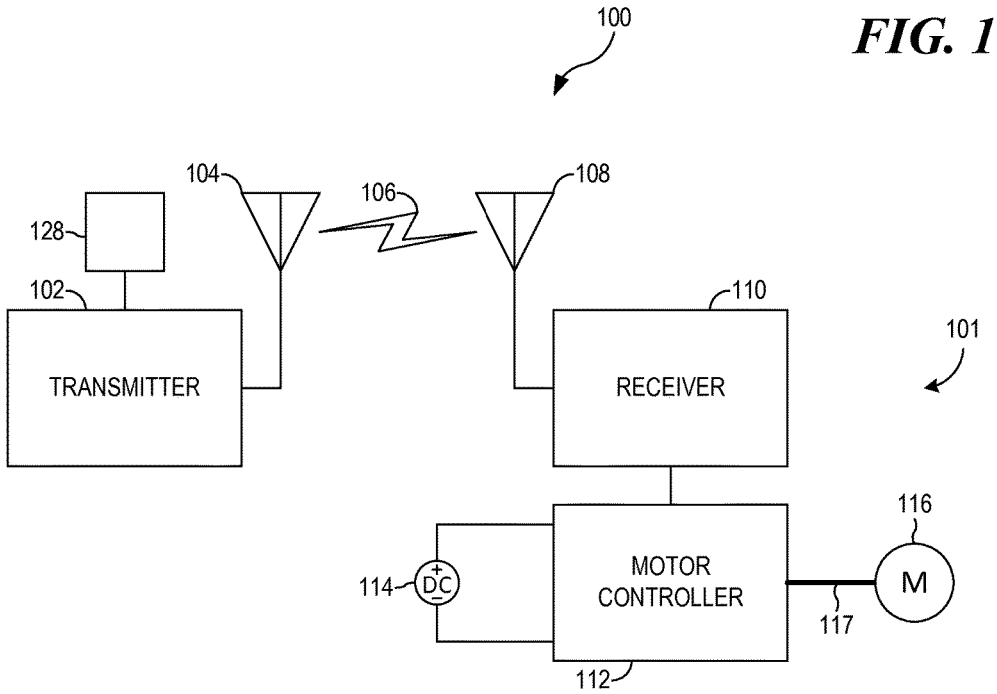
FIG. 1 is a block diagram illustrating a system for operating a remote controlled model vehicle.

I. Introduction of A System 100 for Control of Remote Controlled Model Vehicle FIG. 1 is a block diagram illustrating a system 100 for control of a remote controlled model vehicle 101. A user of the model vehicle 101 may use a transmitter 102 to provide control input to the model vehicle. Accordingly, the user may manipulate controls on a user interface 128 located on the transmitter 102 to control speed and direction of the model vehicle. The user may further manipulate the controls on the user interface 128 to switch the control strategy applied to one or more motors 116 of the model vehicle 101 between two or more modes of operation.

The transmitter 102 comprises a first antenna 104 for transmitting user input to a receiver 110. The receiver 110 comprises a second antenna 108 for receiving the user input from the transmitter 102. In some embodiments, the transmitter 102 transmits a radio frequency signal 106 to the receiver 110. The receiver 110 is coupled to one or more motor controllers 112 and may be located on the model vehicle 101.

The motor controller 112 receives the user input from the receiver 110 and may change the operating mode of the motor controller 112 according to the operating conditions of the model vehicle. In some embodiments, the user manually selects a mode of operation for the motor 116, and in other embodiments, the operating conditions for example the speed, power output, or other condition may automatically trigger a transition between a first mode and a second mode of operation of the motor.

A battery 114 may supply the motor controller 112 with power. Overall, the battery 114 supplies the motor controller 112 with power, and the motor controller 112 can manage a control strategy for power supplied to the motor 116 in response to the user input.

In some embodiments the motor controller 112 may enable a user to control electric power applied to the motor 116 within each mode of operation. Each mode of operation may comprise one or more vehicle speed profiles, which relate to the rate that a rotor of the motor is advanced. For example, a user of the model drag car race vehicle may want to control the vehicle more precisely at low speeds to facilitate staging of the vehicle. The user may change the mode of operation of the vehicle so that a different vehicle speed profile is applied to the motor(s).

II. A First Embodiment of the System 100 Having One Motor

A. Components of A First Embodiment

Figure 2A:
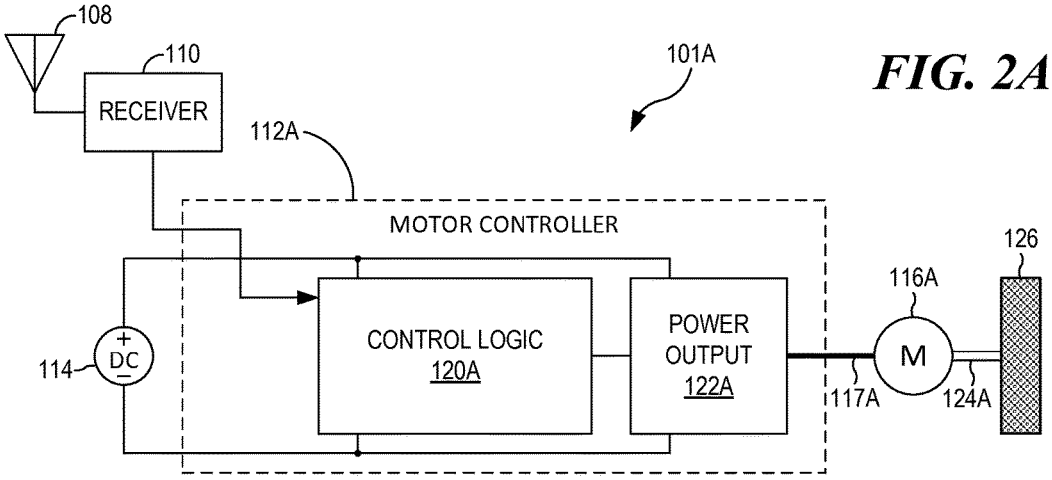
FIG. 2A is a detailed block diagram illustrating a first embodiment of a motor controller operationally coupled to a motor.
Figure 3A:
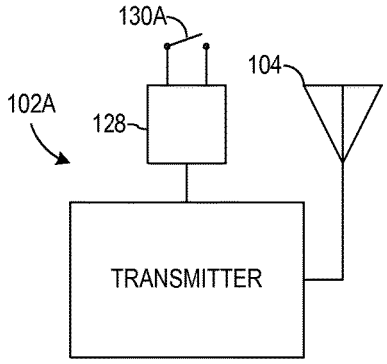
FIGS. 3A and 3B are a detailed block diagram illustration and side view of a transmitter, respectively, having a switch for transitioning between modes of operation of a model vehicle.

FIG. 2A is a detailed block diagram illustrating a first embodiment of the system 100 described in FIG. 1 for controlling a remote controlled model vehicle 101A. The system 100 may comprise a motor controller 112A coupled to the receiver 110. Referring to FIG. 3A, a transmitter 102A may comprise a user interface 128 having a user control feature 130, such as a switch, configured to supply a manually selected user input which is transmitted by the antenna 104 as a signal to the receiver 110. The motor controller 112A may receive a user input from the receiver 110 (as shown in FIG. 1) via the signal 106. The motor controller 112A in FIG. 2A may supply power by managing current and/or voltage provided to the motor 116A for advancement of a rotor 124A of the motor 116A, according to a vehicle speed profile.

Referring to FIG. 2A, the battery 114, such as a DC battery, may supply power to the motor controller 112A. The motor controller 112A may comprise a control logic 120A, and a power output 122A.

The motor controller 112A may be operationally coupled to the motor 116A for supplying power for movement of the rotor 124A of the motor 116A. The rotor 124A in turn may be operationally coupled to one or more wheels 126 of the model vehicle 101A.

The user interface 128 enables the user to control the operation of the motor controller 112A. The user control feature 130 may be configured to change or transition the operation of the electronic control device which may in turn control the motor 116A in one or more modes of operation. In some embodiments, the user control feature 130 may comprise a button, switch (shown in FIG. 3A) or other device known by persons of ordinary skill for manual switching or toggling between modes. In other embodiments, the user control feature 130B (shown in FIG. 3C) may comprise a throttle control, such as a knob or trigger, for automatic changing between modes of operation, according to the operating conditions of the model vehicle.

Referring to FIG. 2A, the control logic 120A manages the power output 122A, wherein the power output 122A can supply power to the motor 116A in response to the user's variable control of throttle input. Therefore, the control logic 120A may manage the voltage and/or current applied to the motor 116A, in response to the desired mode of operation and the user input from the received by the receiver 110.

The power output 122A may be configured to supply power from the battery 114 to the motor 116A. In some embodiments, the motor 116A may comprise a sensorless brushless DC motor having, for example, three stator phases and 2 or 4 rotor poles. The power output 122A may then be configured with transistors and a wired connection 117A suitable for operation of the motor 116A. It would be understood by persons of ordinary skill in the art that motors with other configurations, stator phases and rotor poles could be interchanged with the motor 116A, which would necessitate accommodating configurations of the connection 117A and power output 122A.

B. Incremental Rotation of Rotor 124A of Motor 116A

Figure 4A:
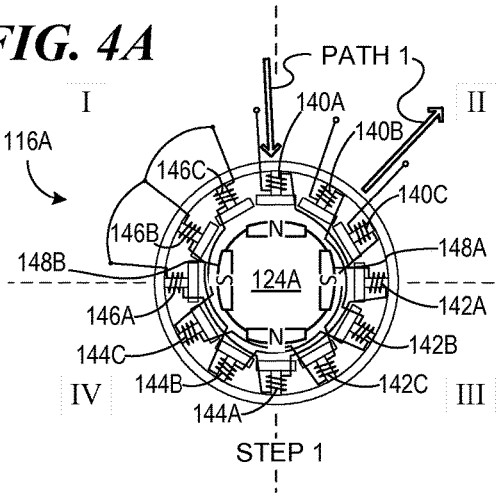
FIGS. 4A, 4B, 4C, 4D, 4E, and 4F are schematics of a motor, and motor coils, illustrating rotor movement through three steps.

Turning now to FIGS. 4A-4F, in one embodiment, the rotor 124A of the motor 116A may be advanced incrementally in fractions of a revolution to allow for precise control of vehicle movement at low speeds. As shown in FIG. 4A, the motor 116A may comprise Group A coils 140A, 142A, 144A, and 146A having A terminal 150, Group B coils 140B, 142B, 144B having B terminal 152, and 146B, and Group C coils 140C, 142C, 144C, and 146C having C terminal 154 and each Group A, B, and C having a common terminal 156, wherein the coils of Group A, B, and C are arranged about the rotor 124A in four quadrants I, II, III, and IV. It will be understood by persons of ordinary skill that the magnitude of the fraction of rotation is determined by the particular number of stator phases and rotor poles of the motor, which may be configured to meet the operating conditions of the vehicle.

Figure 4B:
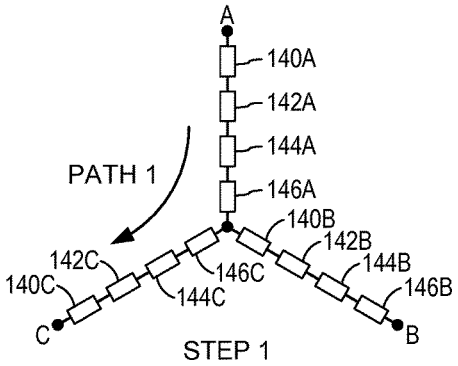

The coils 140, 142, 144, and 146 may be electrically arranged in a "Y" configuration schematically shown in FIG. 4B. The Y configuration may allow current to flow via electrical Path 1, Path 2, or Path 3. As the coils are energized with current, the rotor 124A may be locked into three positions per quadrant I, II, III, and IV. The commutation of the coils 140, 142, 144, and 146 allows three incremental rotations—Steps 1, 2, and 3 shown in FIGS. 4A-4F—of the rotor 124A of thirty degrees (30) per quadrant I, II, III, and IV. A continued sequence of commutations allows the rotor 124A to rotate through the quadrants I, II, III, and IV in twelve (12) increments to complete one full revolution of the rotor 124A.

The rotor 124A is actuated for movement in increments by energizing the coils to cause magnetic North/South poles to magnetically form in the coils. As shown in FIGS. 4A and 4B in Step 1, current is applied to the Group A and Group C coils along Path 1 causing each of the Group A coils 140A, 142A, 144A, and 146A to each form a North pole and each of the Group C coils 140C, 142C, 144C, and 146C to each form a South pole. No current is applied to Group B coils 140B, 142B, 144B, and 146B. Referring to FIG. 4A, a South pole 148 of rotor 124A is magnetically attracted to the North pole formed by the Group A coils 142A and 146A, and magnetically repelled by the Group C coils 140C and 144C. This arrangement shown in Step 1 may cause rotational movement of the rotor 124A from an initial position of the rotor 124A to the position shown in FIG. 4A.

Figure 4C:
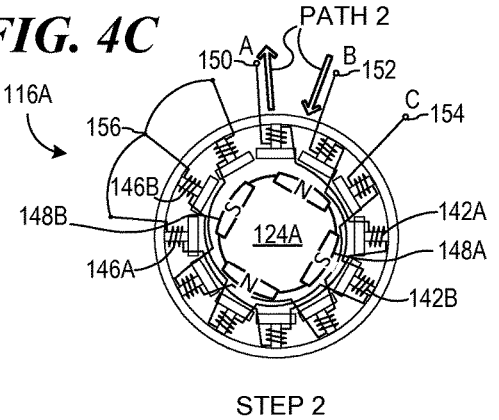
Figure 4D:
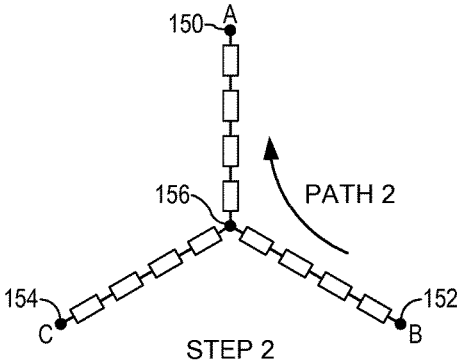

In Step 2 as shown in FIGS. 4C and 4D, current is applied to the Group B and Group A coils along Path 2 causing each of the Group B coils 140B, 142B, 144B, and 146B to each form a North pole and each of the Group A coils 140A, 142A, 144A, and 146A to each form a South pole. No current is applied to Group C coils 140C, 142C, 144C, and 146C. Referring to FIG. 4C, the South poles 148A and 148B of rotor 124A is magnetically attracted to the North pole formed by the Group B coils 142B and 146B, and magnetically repelled by the Group A coils 142A and 146A. This arrangement shown in Step 2 may cause rotational movement of the rotor 124A from its position of the rotor 124A shown in Step 1 (FIG. 4A) to the position shown in FIG. 4C for Step 2.

Figure 4E:
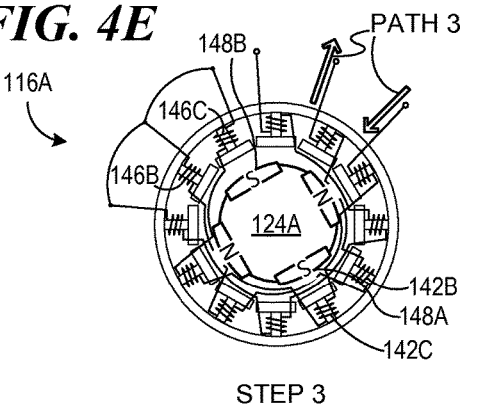
Figure 4F:
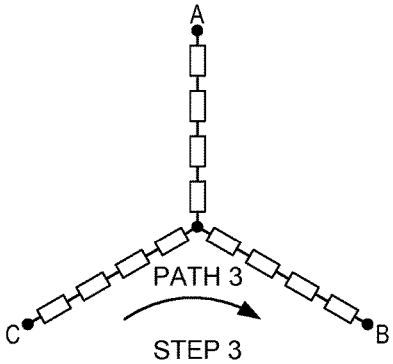
Figure 4G:
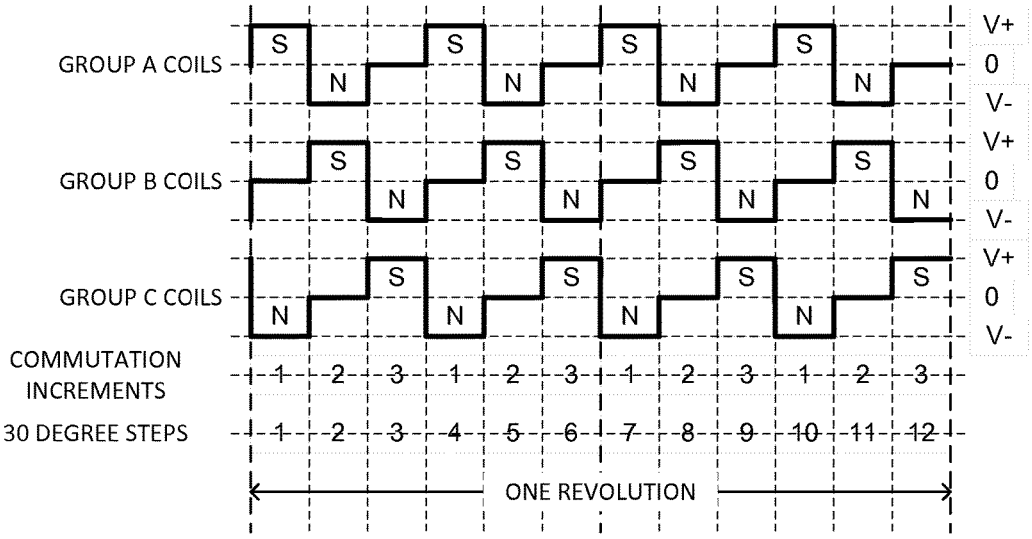
FIG. 4G is a diagram depicting motor coils being energized in twelve increments to complete one revolution of a rotor.

In Step 3 as shown in FIGS. 4E and 4F, current is applied to the Group C and Group B coils along Path 3 causing each of the Group C coils 140C, 142C, 144C, and 146C to each form a North pole and each of the Group B coils 140B, 142B, 144B, and 146B to each form a South pole. No current is applied to Group A coils 140A, 142A, 144A, and 146A. Referring to FIG. 4E, the South poles 148A and 148B of rotor 124A is magnetically attracted to the North pole formed by the Group C coils 142C and 146C, and magnetically repelled by the Group B coils 142B and 146B. This arrangement shown in Step 3 may cause rotational movement of the rotor 124A from its position of the rotor 124A shown in Step 2 to the position shown in FIG. 4E for Step 3.

Applying current to the coils in Groups A, B, and C in the manner described above in FIGS. 4A-4F may result in rotation of the rotor 124A through a first quadrant III in three increments of thirty degrees. Continued application of current according to Steps 1-3 may result in rotations through all four quadrants I, II, III, IV for one complete rotation, and for multiple rotations.

The time interval for the application of current to the coils in each step may be varied to increase the rate of incremental turns. The rate of incremental turns may be increased as a user increases the throttle setting at the throttle control to increase the speed of the model vehicle. For example, in the staging speed profile 204 shown in FIG. 5B, the user may engage the throttle control resulting in a decrease in time interval for the application of current to each group of coils, according to the Steps 1-3. The result is that speed of the vehicle may increase until it reaches the desired staging speed.

C. Staging Mode

A staging mode for the model vehicle may be engaged by the user selecting the mode via the user interface 128. The staging mode may comprise operation of the vehicle according to the speed profile 204 shown in FIG. 5B. In some embodiments, a switch 130 may be used to toggle between one or more modes, where a first mode may comprise the staging mode.

Figure 5A:
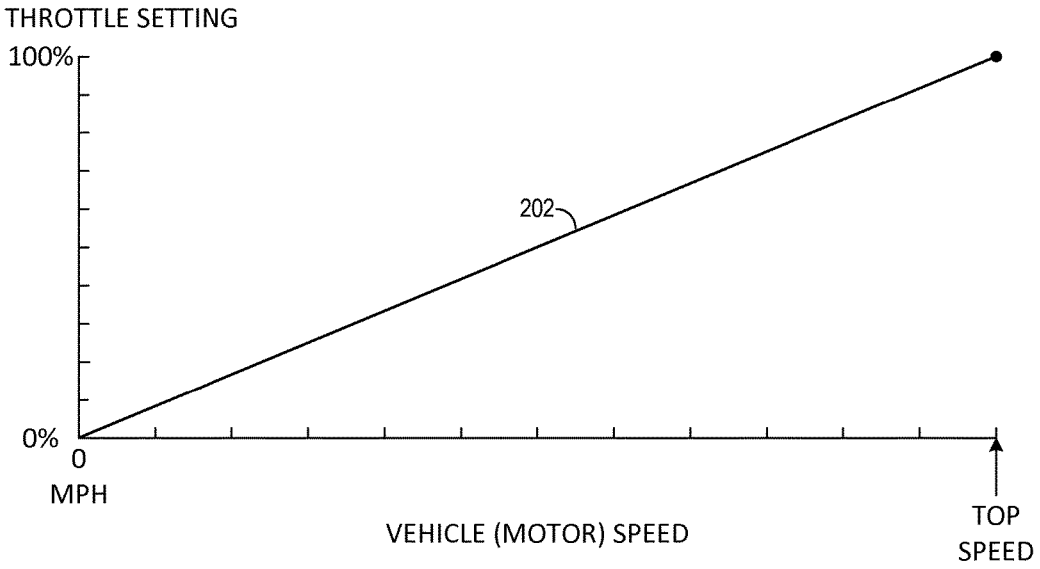
FIGS. 5A, 5B, 5C, and 5D are four diagrams depicting speed profiles for a remote control model vehicle.

As shown in FIG. 5A, in a conventional "race" mode, the model vehicle 101A may operate according to a race speed profile 202, where speed of the model vehicle 101A, as it relates to the rate of rotation of the rotor 124A of the motor 116A, increases in a gradual manner from a throttle setting of "0," indicating no power to the motor 116A, to a full or 100% throttle setting, indicating full power. At no power, setting 0, the model vehicle 101A may be stationary, assuming no prior speed input to the model vehicle, and at 100% throttle the model vehicle 101A may achieve its "top speed." In race mode, the motor controller 112A may commutate the motor 116A in substantially closed-loop through substantially the entire range of throttle input, using feedback from the motor 116A to control rotation of the rotor 124A and thus movement of the model vehicle 101A. This mode may be utilized when the model vehicle 101A is racing other vehicles, because it allows the user to control the vehicle through its entire range of speed—from zero to its top speed.

As shown in FIG. 4B, in the staging mode, the model vehicle 101A may operate according to a staging profile 204, where speed of the model vehicle 101A increases within a limited range of speed to a maximum "staging" speed. The rate of advancement of the rotor 124A in multiple incremental turns, for instance one-twelfth turns, is increased until the model vehicle 101A reaches the "staging speed limit," which in some embodiments may be about 3-4 miles per hour. In this mode, the model vehicle 101A crawls at or lower than the staging speed limit towards its intended destination. FIG. 4C illustrates a comparison of the race profile 202 and the staging profile 204.

In some embodiments, incremental advancement of the rotor of a sensorless brushless DC motor may be accomplished by the motor controller 112A commutating the motor 116A in open-loop, without use of feedback from sensors or other motion data. In some embodiments, the method of incremental advance of the rotor 124A through twelve steps as discussed in FIGS. 4A-4F above may be implemented to control rotational motion of the rotor 124A. It would be understood that the staging speed limit or rate of increase of speed in the staging mode can be set in some embodiments, either as a preset feature during manufacturing of the motor controller 112A or as a configurable feature, where the user sets the staging speed limit or rate of change of speed to his or her preference.

The staging mode may be utilized when the user wants precision control of the model vehicle 101A at low travel speeds, without jerky or large movement that is characteristic of conventional motors for model vehicles when operated at low speeds. The staging mode may be utilized to stage a drag car model vehicle, where the drag car model vehicle must be maneuvered at low speeds to set its front end on a racing starting line. Once the model vehicle 101A is staged, it may be transitioned to a second mode, such as a race mode, for racing the model vehicle 101A.

Other types of model vehicles may utilize the staging modes described here, including model off-road vehicles, where precise control of wheel rotation is desired.

III. A Second Embodiment of the System 100 Having Two Motors

Figure 2B:
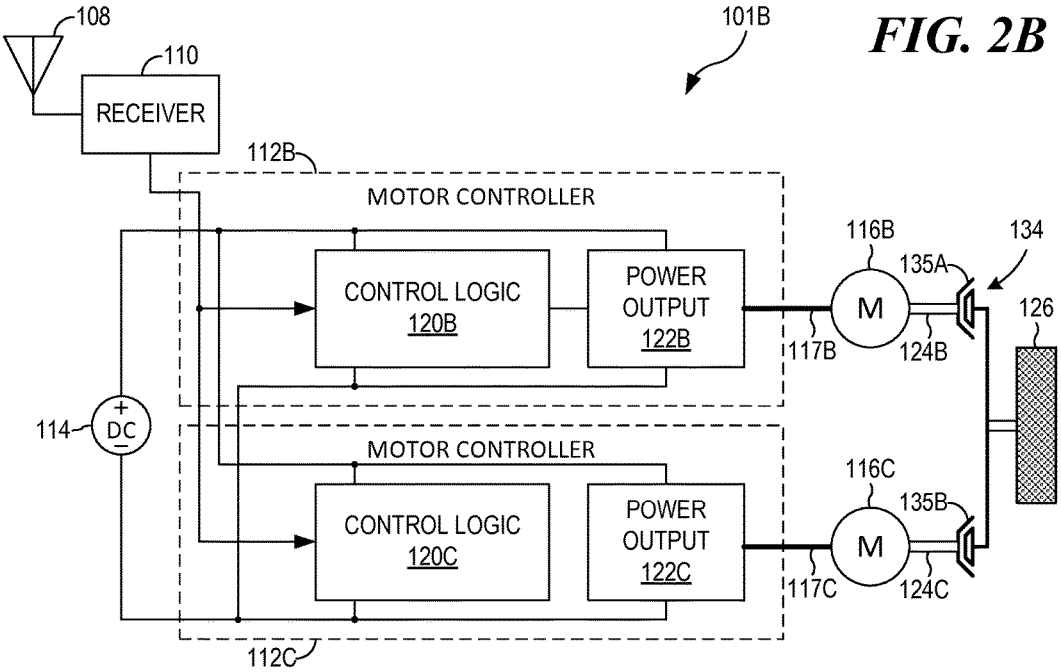
FIG. 2B is a detailed block diagram illustrating a second embodiment of a motor controller operationally coupled to a first motor and a second motor.

FIG. 2B is a detailed block diagram illustrating a second embodiment of the system 100 for operating a remote controlled model vehicle 101B. The system 100 comprises a first motor 116B and a second motor 116C. The motors 116B and 116C are configured to hand over powering the vehicle between each motor, 116B or 116C. In some embodiments, the first motor 116B is configured for movement of the model vehicle 101B in a first mode of operation, and the second motor 116C is configured for movement of the model vehicle 101B in a second mode of operation.

The system 100, as shown in FIG. 2B, may comprise a first motor controller 112B and a second motor controller 112C coupled to the receiver 110. The motor controllers 112B and 112C and the receiver 110 may be configured to operate with the transmitter 102A and 102B shown in FIGS. 3A and 3C, respectively. The motor controllers 112B and 112C may receive a user input from the receiver 110 (FIG. 1).

The motor controllers 112B and 112C may regulate power by managing voltage and/or current supplied to the motors 116B and 116C, respectively for advancement of the rotors 124B and 124C of each respective motor 116B and 116C of the motor 116 according to a vehicle speed profile. The battery 114 may supply power to both motor controllers 112B and 112C. Each motor controller 112B and 112C may comprise a control logic 120B and 120C, respectively. It would be understood by persons of ordinary skill in the art that the motor controllers 112B and 112C and each respective control logic 120B and 120C may be integrated into a single component, e.g. all the associated electronics housed in the same enclosure, having the same or similar functionality and capability as though the components were manufactured and assembled into the system 100 separately.

The motor controllers 112B and 112C may be operationally coupled to the first motor 116B and the second motor 116C, respectively, for supplying power for movement of a respective rotor 124B and 124C of each respective motor 116B and 116C. The rotors 124B and 124C in turn may be coupled to one or more wheels 126 of the model vehicle 101B through a power transmission device 134, such as a clutch, having clutch device portions 135A and 135B for engaging and disengaging the rotor 124B and 124C, respectively, from the wheel(s) 126. For example, the first motor 116B may be connected to a drive train via an overrunning clutch such that when the second motor 116C is being run the first motor 116B is effectively disconnected from the drive train. It would be understood by persons of ordinary skill in the art that other mechanical means of switching transmission of mechanical power between the rotors 124B and 124C and the wheels 126 could be implemented, such as a disengageable gear set.

It would be further understood by persons of ordinary skill in the art that different arrangements for operation of the motors 116B And 116C can be implemented; for example, the clutch device portion 135A may disengage the second motor 116C from operational connection with the wheels 126 while the model vehicle 101B is in a first mode of operation allowing the first motor 116B to drive the wheels 126. In a second mode of operation, the clutch device portion 135B may engage the second motor 116C to drive the wheels 126, and leave the first motor 116B engaged but unpowered so that the rotor 124B of the first motor 116B rotates with powered rotation of the rotor 124C of the second motor 116C.

Figure 5B:
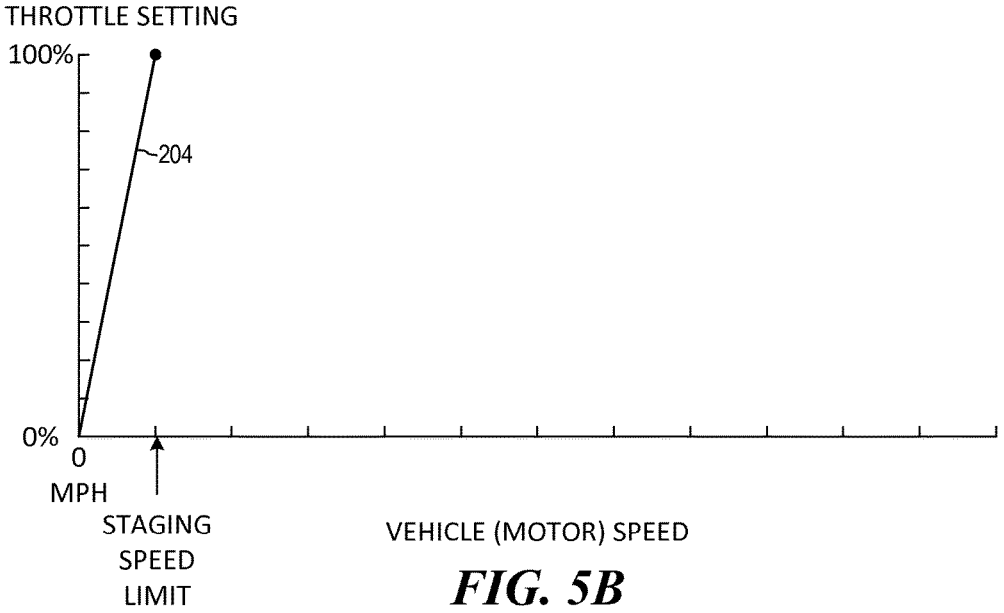
Figure 5C:
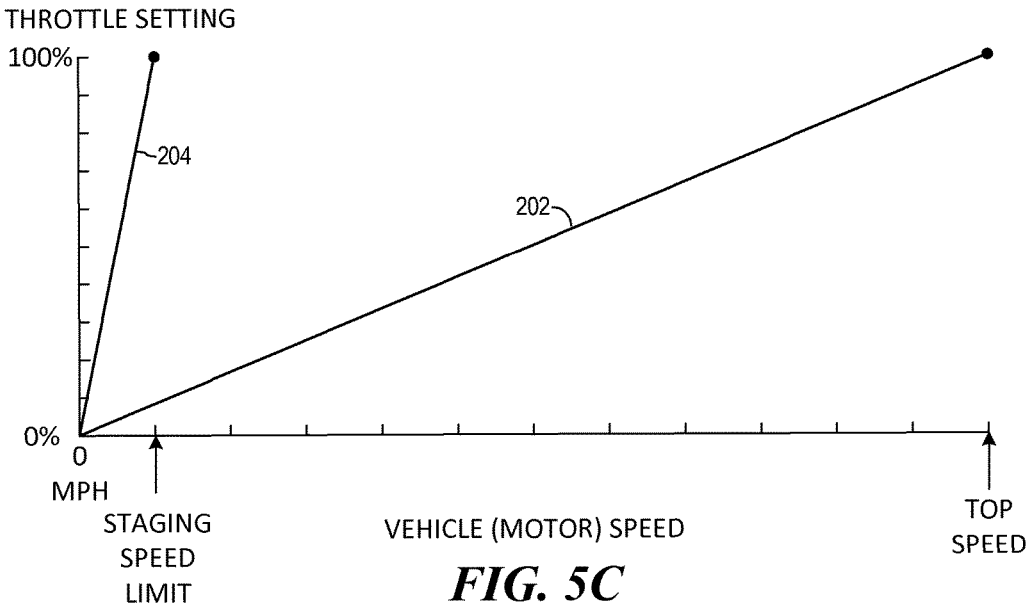

The first motor 116B may be configured for low speed movement of the model vehicle 101B. The motor controller 112B may operated the first motor 116B in a manner according to the staging mode illustrated by the staging speed profile 204 as shown in FIG. 5B, or the low speed mode shown in Part A of the profile 206 as shown in FIG. 5C, described below.

Referring to FIG. 2B, the first motor 116B may comprise a motor configured for precise low speed control such as a brushed permanent magnet direct current (PMDC) motor. The first motor 116B and the motor controller 112B may be relatively low power as compared to the second motor since only low speed and possibly intermittent operation is required. The first motor 116B may be operated in open loop for advancement of the rotor 124B. The motor 116B may also be connected to the wheels with a large gear reduction ratio so that rotation of the wheel is a small fraction of the rotation of the rotor.

Figure 5D:
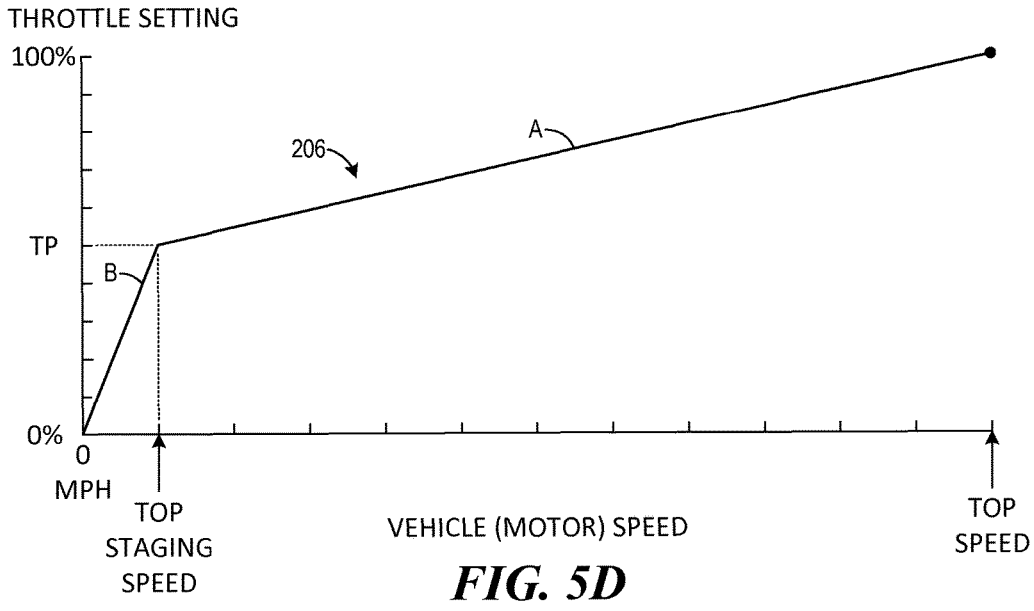

Powering of the model vehicle 101B may transition between the staging or low speed mode and a second mode, for instance the race mode illustrated by the race speed profile 202, as shown in FIG. 5A, or the high speed mode shown in Part B of the profile 206, as shown in FIG. 5D, described below.

The second motor 116C may be configured for operation of the model vehicle 101B in the race or high speed modes, referenced above. The transition between the first motor 116A and the second motor 116C may be triggered by a manual user input, for example through the switch 130A shown and described in FIG. 3A, or by an automatic transfer of power to one of the first motor 116B or the second motor 116C, when the user moves a throttle beyond a certain range; for example, when the user moves the throttle control 130B beyond a staging operation range of the throttle, as shown and described in FIGS. 3C, 6A, 6B, and 6C.

Referring to FIG. 2B, the second motor 116C may comprise a motor suitable for conventional operation of the model vehicle, for example, in a mode like race mode where a user has full use of the power available from the battery and motor to reach top speed. The second motor 116C may comprise a sensored or sensorless brushless DC motor and may be commutated in closed loop for full use of the range of available power and speed provided by the battery 114 and the second motor 116C.

IV. Transition Between Modes

A. Transition Between Modes Using Switch 130A

In some embodiments, user may transition the model vehicles 101A and 101B between modes of operation, for example between the staging mode and the race mode, by the user manually toggling the switch 130A (shown in FIG. 3A), or operating some other user control feature provided on the transmitter 102A, to engage the staging mode.

Figure 3B:
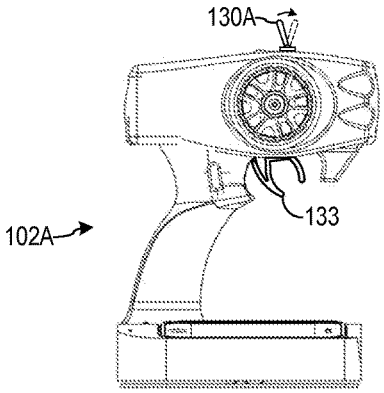

When the model vehicle 101A or 101B is in staging mode, the model vehicle may be moved by remote control, e.g. the transmitter 102A, by actuating a throttle control 133, such as a throttle trigger, which may be positioned on the transmitter 102A with the switch 130A. FIG. 3B shows one embodiment of the transmitter 102A, shown in block diagram form in FIG. 2A. In some embodiments, where the switch 130A is in a staging mode position, the model vehicle may be operated by pulling the throttle trigger 133. In some embodiments, the throttle trigger may be pulled about halfway through its travel before the vehicle is powered.

In response to pulling the trigger 133, the model vehicle 101A, shown in FIG. 2A, may "click" toward the starting line as the rotor 124A of the motor 116A moves the model vehicle in 30 degree increments of 1/12 turn of the rotors 124A or 124B. The user may move the model vehicle 101A in single increments by tapping the throttle trigger 133. In other embodiments utilizing a PMDC motor as an auxiliary motor for low speed travel, such as model vehicle 101B, the vehicle may move at low speed operating in a similar manner as the model vehicle 101A, but without the option to move the rotor 124B of the motor 116B in repeatable discrete increments.

As the throttle trigger 133 is pulled further toward its full throttle setting the model vehicle (either 101A or 101B) will move faster, and according to the speed profile 204, shown in FIG. 5B until it reaches the staging speed limit at full throttle. Once the model vehicle is staged, the switch 130A may be toggled to engage one or more other modes of operation, e.g. race mode, a burn out mode, or other mode.

It will be understood by persons of ordinary skill in the art that the user control interface may be alternatively located on the model vehicle, for example in the form of a switch located on the vehicle that the user toggles between modes.

B. Automatic Transition Between Modes Using User Control Feature 130B

Figure 3C:
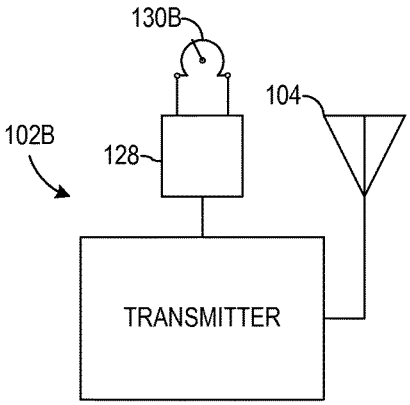
FIG. 3C is a detailed block diagram illustrating a transmitter having a throttle trigger for transitioning between modes of operation of a model vehicle.

In other embodiments, the user may transition the model vehicles 101A and 101B between modes of operation by actuation of the throttle input, without use of separate user control, such as switch 130A (shown in FIG. 3A) so that the transition is automatic based on one or more operating conditions of the vehicle. Referring to FIG. 3C, there is shown an embodiment of the transmitter 102B. This embodiment of a transmitter 102B may used in conjunction with the system 100 as shown and described in FIG. 1 and FIG. 2A, having one motor 116A, or the system 100 as shown and described in FIG. 2B, having two motors 116B and 116C.

Figure 6A:
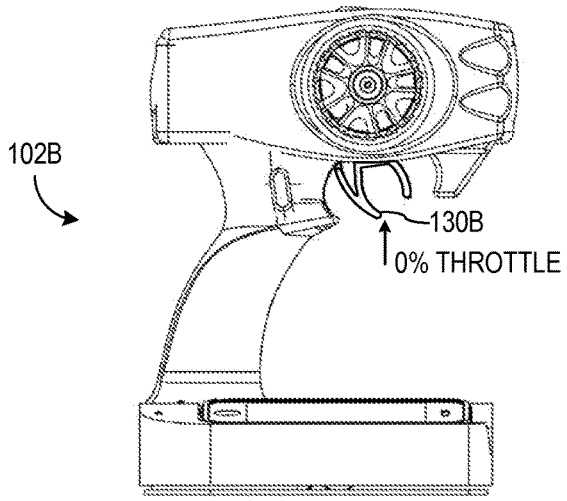
FIGS. 6A, 6B, and 6C are three front views of a transmitter showing a throttle trigger actuated in three positions.

Referring to FIG. 6A, there is shown one embodiment of the transmitter 102B in three different positions. The user interface 128 may comprise a user control feature 130B, which may comprise a throttle control, such as a throttle trigger (shown in FIG. 6), knob or other known control feature as shown in Figure. The throttle control 130B may be configured to generate an indication that a transition point (TP shown in FIGS. 6B and 5D) in model vehicle speed has been reached in response to an operating condition of the model vehicle (either 101A or 101B), as it relates to the rate of rotation of the rotor of the model vehicle motor. The indication can be transmitted as a signal via the antenna 104 to the receiver 110 and to the motor controller 112A in the embodiment in FIG. 2A or the motor controllers 112B and 112C in FIG. 2B.

As shown in FIG. 5D, the motor controller 112A (or 112B and 112C) may be configured to operate the model vehicle in a first low speed mode, which may be represented by profile part A in the profile 206. In the low speed mode for the system 100 shown in FIG. 2A, the motor controller 112A may be configured to commutate the motor 116A to advance the rotor 124A incrementally in a manner similar to the staging mode, e.g. in open loop, described above. In the low speed mode for the system 100 shown in FIG. 2B, the motor controllers 112B and 112C may be configured to operate the first motor 116C, which in some embodiments is a PMDC motor configured for low speed travel of the vehicle.

Referring again to FIG. 5D, in the low speed mode, the speed of the vehicle, as it relates to the rate of rotation of the rotor 124A of the motor 116A (or 124B and 116B, respectively), may increase from zero to a transition speed at a transition point (TP). In some embodiments the transition speed is about 3-4 miles per hour to accommodate use of the low speed mode in staging of the model vehicle 101A or 101B. It will be understood by persons of ordinary skill that the transition speed may be configurable, either manually by the user or as a factory setting that the user cannot change.

Actuation of the throttle control 130B by the user passed a certain setting on the throttle control 130B, which may be correlated by the motor controller 112A or the motor controllers 112B and 112C to the rate of rotation of the rotors of the motor 116A or motors 116B and 116C, may result in transition from between low speed mode to a second mode, represented by Part B of profile 206 in FIG. 5D.

Figure 6B:
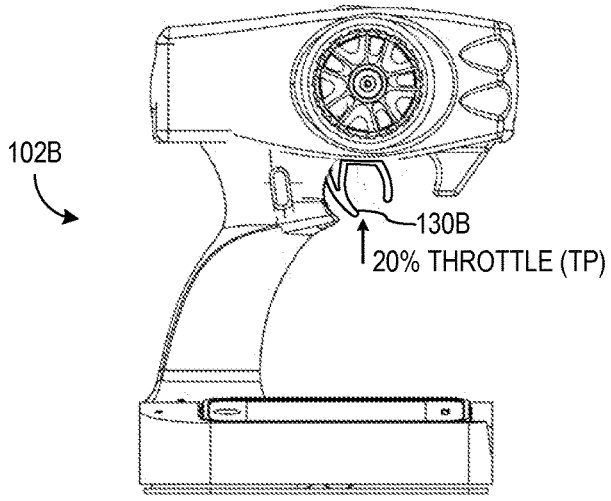
Figure 6C:
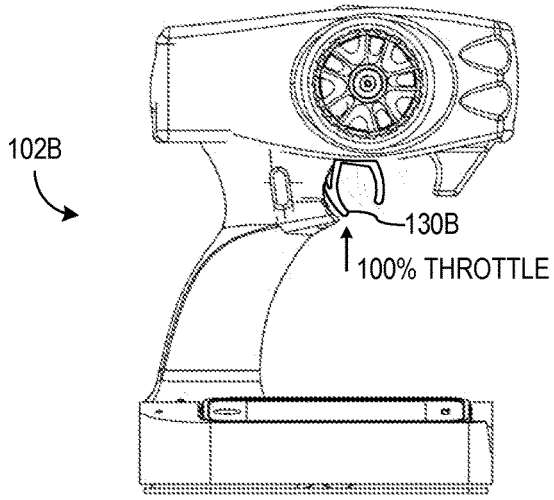

Referring to FIGS. 6A, 6B, and 6C, in some embodiments, the user may actuate the throttle control 130B by actuating a throttle trigger within a low speed mode range, for example by pulling the trigger to travel within 0-20% from its "0" setting, shown in FIG. 6A. When the throttle control is actuated passed the transition point, which may be about 20% into the throttle range of travel (shown in FIG. 6B), the vehicle may operate in full speed or race mode up to the 100% or full throttle setting shown in FIG. 6C. It will be understood by persons of ordinary skill in the art that the low speed mode range of travel for the trigger may be configured during manufacturing of the model vehicle or may be adjustable by the user.

Operating the throttle control 130B in a low speed range may result in speeds of the vehicle between zero and 3-4 miles per hour, and the motor 116A or 116B. Pulling the trigger past the transition point (TP), as shown in FIG. 6, may engage the high speed mode profile of Part B in FIG. 5D resulting in the motor controller 112A or motor controller 112C commutating the motor 116A or second motor 116C, respectively, in closed loop.

V. Use of Sensored Other DC Motors in the System 100

In some embodiments, the motor 116A, as shown in FIG. 2A, may comprise a brushless sensored DC motor, where the motor controller 112A and the power output 122A are configured to control the motor 116A according to at least the speed profiles 202, 204, and 206 shown in FIGS. 5A, 5B, 5C, and 5D. The connection 117A may further include wired connections, as needed, for sensors located on the motor 116A for providing data relating to rotor movement.

In other embodiments, the second motor 116C, as shown in FIG. 2B, may comprise a brushed DC motor. The motor controller 112C and the power output 122C are configured to control the second motor 116C according to at least the speed profiles 202, 204, and 206 shown in FIGS. 5A, 5B, 5C, and 5D.

The motors 116A and 116C, configured as a described above, may be also be used in embodiments where transition between one or modes of operation of the model vehicle 101A and 101B, respectively, is manual or automatic.

VI. Use of Electronic Speed Control for Low Speed Control of Model Vehicle

Figure 7:
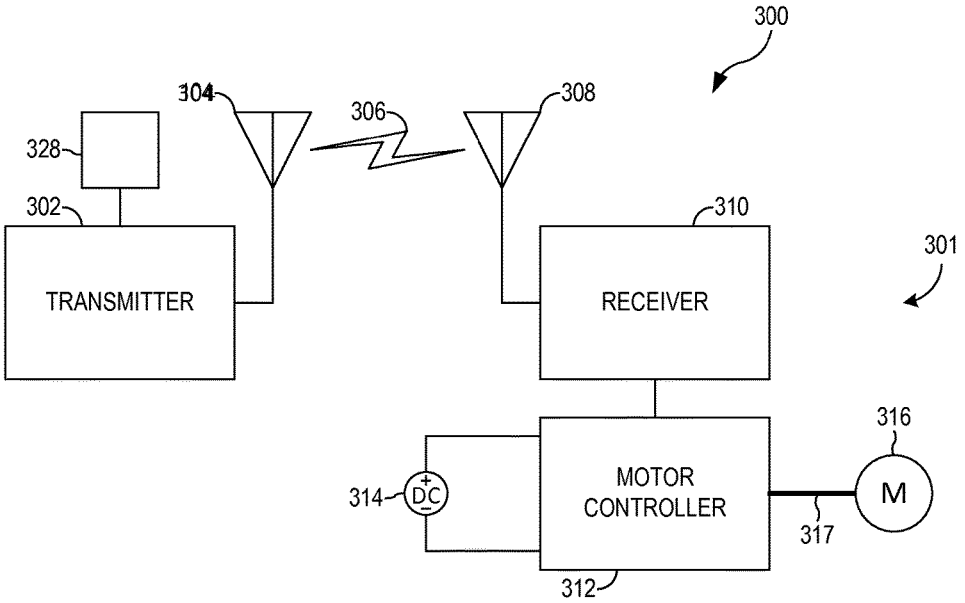
FIG. 7 is a block diagram illustrating a system for controlling the motion of one or more motors in a remote controlled model vehicle.

A model vehicle may also be configured for staging by reducing the throttle sensitivity across the range of throttle setting of a model vehicle 301, as shown in FIG. 7. A system 300 for operating a model vehicle 301 at low speeds using a reduced throttle sensitivity may comprise a transmitter 302 to provide control input to the model vehicle. Accordingly, the user may manipulate controls located on the transmitter 302 to control speed and direction of the model vehicle.

The user may further manipulate the controls on the transmitter 302 to switch the control strategy applied to one or more motors 316 of the model vehicle between two or more modes of operation.

The transmitter 302 may comprise a first antenna 304 for transmitting user input to a receiver 310. The receiver 310 may comprise a second antenna 308 for receiving the user input from the transmitter 302. In some embodiments, the transmitter 302 transmits a radio frequency signal 306 to the receiver 310. The receiver 310 is coupled to one or more motor controllers 312 and may be located on the model vehicle 301.

The motor controller 312 receives the user input from the receiver 310 and may change the operating mode of the motor controller 312 according to the operating conditions of the model vehicle. In some embodiments, the user manually selects a mode of operation for the motor 316, and in other embodiments, the operating conditions for example the speed, power output, or other condition may automatically trigger a transition between a first mode and a second mode of operation of the motor.

In a first mode, the sensitivity of the throttle may be scaled by a factor x, e.g. 90%. This may result in a 90% reduction of the magnitude of average power applied across the range of throttle range, which may limit the model vehicle top speed. In some embodiments, operating the model vehicle in the first mode limits the speed of the vehicle across the range of throttle settings to allow a user to stage the vehicle by moving the vehicle at low speeds to a race starting line.

Figure 8:
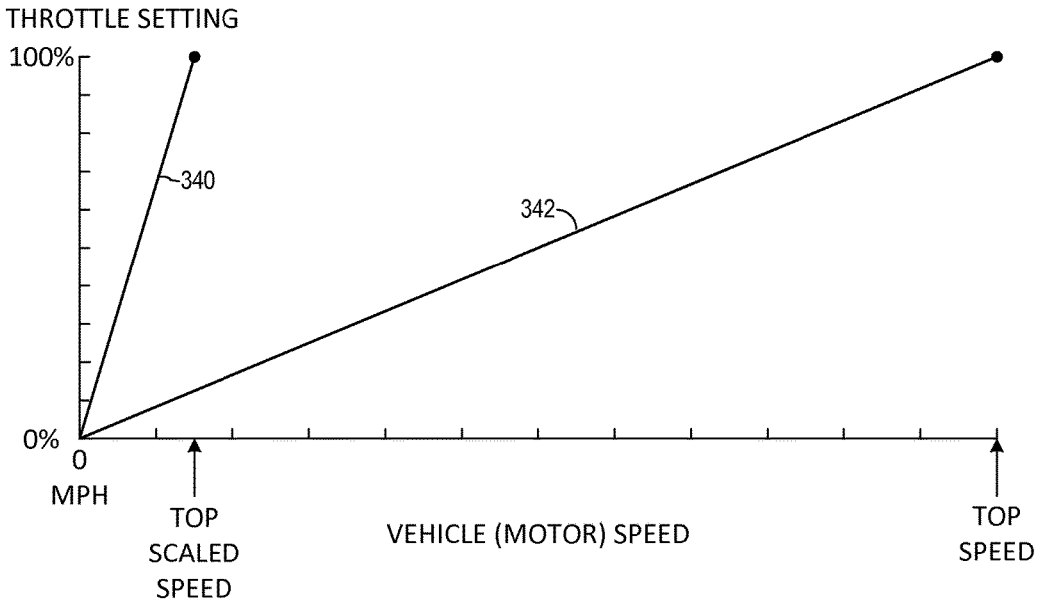
FIG. 8 is a diagram depicting a speed profile scaled by a factor x from a full speed profile.

In a second mode, the throttle may operate with its maximum average power, allowing the user to accelerate the model vehicle 301. In FIG. 8, scaled speed profile 340 illustrates (not drawn to scale) the operation of the model vehicle 301 in the first mode, applying a 90% reduction in the maximum average power applied by the motor controller 312 across the throttle range. The scaling down of throttle sensitivity limits the top speed of the vehicle to a top scaled speed. Comparatively, full power speed profile 342 illustrates the operation of the model vehicle 301 in the first mode, applying no reduction in the maximum average power applied by the motor controller 312, allowing the model vehicle to reach its top speed.

A battery 314 may supply the motor controller 312 with power. Overall, the battery 314 supplies the motor controller 312 with power, and the motor controller 312 can manage a control strategy for power supplied to the motor 316 in response to the user input.

In some embodiments the motor controller 312 may enable a user to control electric power applied to the motor 316 within each mode of operation. Each mode of operation may comprise one or more vehicle speed profiles, which relate to the rate that the rotors of the motor 316 are advanced. For example, a user of the model drag car race vehicle may want to control the vehicle more precisely at low speeds to facilitate staging of the vehicle. The user may change the mode of operation of the vehicle so that a different vehicle speed profiles profile is applied to the motor(s).

One system and method for scaling the throttle output of the motor controller 112 is disclosed in U.S. patent application "LOW POWER ELECTRONIC SPEED CONTROL FOR A MODEL VEHICLE" (Ser. No. 11/455,984, referred to as the "ESC Application") which is here incorporated. In some embodiments, the motor controller 312 may substantially comprise the functionality provided by the electronic speed control device (disclosed as motor controller 112) in the ESC Application.

In some embodiments, the functionality of scaling the throttle sensitivity in the first mode may be built into the transmitter 302, and operable by user controls on a user interface 328. The scale factor x may be user selectable for variable control of the magnitude of average power applied by the motor controller 312.

The transmitter 302 may send signals configured to perform the function the motor controller 312 in applying voltage to the one or more motors 312. In other embodiments, the transmitter 302 may send a signal in response to a user input configured to put the motor controller 312 into a desired mode of operation, including a first mode for operation of the model vehicle 301 at low speeds.

It will be understood by persons of ordinary skill in the art that movement of the model vehicles 101A shown in FIG. 2A, 101B shown in FIG. 2B, or 301 shown in FIG. 7, in any of the modes of operation providing for any of the speed profiles, e.g. staging, race, low speed, high speed, scaled speed, may be operated to move the vehicle in the forward or reverse direction. It will be further understood that the motors, motor controllers, receivers, transmitters associated with each of the model vehicles disclosed here may be configured to operate the model vehicles in any of the modes of operation providing for any of the speed profiles, e.g. staging, race, low speed, high speed, scaled speed, in the forward or reverse direction.

VII. Launch Control Mode

The system 100 for control of a remote controlled model vehicle may further comprise a launch control mode for simulating launch control systems found in full size drag cars. In full size drag cars the driver may rev the engine to a racing level of revolutions per minute (rpm). The driver may hold the rpm level without moving the car until the racing light goes green, when the driver launches the car for racing.

Figure 3D:
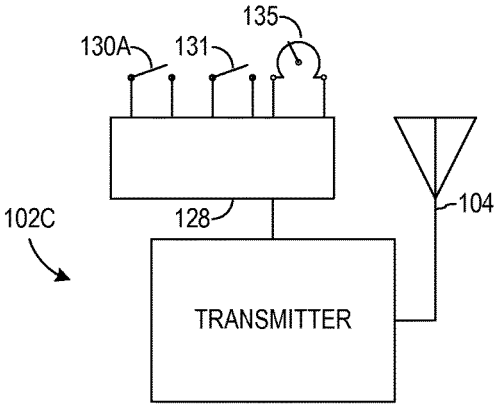
FIGS. 3D and 3E are a detailed block diagram illustration and side view of a transmitter, respectively, having a switch for transitioning between modes of operation of a model vehicle and having a launch control feature and a torque control setting.

Turning now to FIG. 3D, there is shown an embodiment of a transmitter 102C for remotely controlling a model vehicle. The transmitter 102C may include similar features as the transmitter 102A, described above and shown in FIGS. 3A and 3B, which are numbered using the same reference numerals. The user interface 128 of the transmitter 102C may comprise a launch control feature configured to allow a user to increase the throttle input to the model vehicle (either 101A or 101B) without moving the vehicle. In some embodiments, the launch control feature may comprise a launch control switch 131 having at least two positions.

Figure 3E:
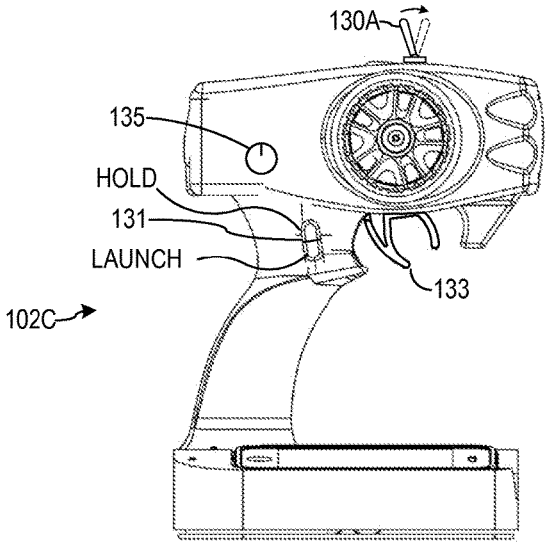

Referring to FIG. 3E, in a first "hold" position, the launch control switch 131 may generate a signal to disengage the throttle trigger 133 from controlling the vehicle so that the user may pull the trigger 133 toward its full throttle setting without any movement of the rotors (either 124A or 124B) of the vehicle (either 101A or 101B). In some embodiments, engaging the hold position comprises pressing a top half of a button of the switch 131.

One advantage of allowing the user to move the throttle trigger 133 without movement of the vehicle is that a user may set a launch throttle setting before the race begins so that when the race starts the user does not need to manually move the trigger from its zero setting to the desired launch throttle setting. In some embodiments, the desired launch throttle setting may comprise full throttle, by the user pulling the throttle trigger 133 all the way back to its 100% setting. In other embodiments, the user may pull the throttle to less than full throttle to accommodate road surface, tire, or other race conditions. For example, the user may pull the throttle trigger 133 to less than 100% to prevent wheel spin.

In a second "launch" position, the launch control switch 131 may generate a signal to engage the throttle trigger 133 to control the vehicle so that the vehicle launches at the launch throttle setting set by the user. In some embodiments, engaging the launch position comprises pressing a bottom half of a button of the switch 131.

In some embodiments, the launch control feature described above may be engaged while the model vehicle is in staging mode. A user may stage the model vehicle using the staging mode. The user may push the upper portion of the button of the switch 131 to allow the throttle trigger 133 to be pulled to the desired launch throttle setting. The user may put the vehicle in race mode by moving the switch 130A from staging mode to race mode. The user may launch the vehicle for racing by pushing the lower half of the button of the switch 131.

VIII. Torque Control Setting

Referring again to FIG. 3D, the transmitter 102C may comprise a throttle control feature to allow the user to limit the range of torque that a motor controller may apply to a motor. In some embodiments, the throttle control feature comprises a variable control input device, such as a knob 135. The knob 135 may be configured to generate a signal to command the motor controller 112A or motor controller 112C to limit current to the motor 116A or 116C, when the model vehicle 101A or 101B is in a race mode. In some embodiments, the motor controller 112A or motor controller 112C may apply a chopped DC voltage at a duty cycle to the motor 116A or 116C to limit torque to the motor 116A or 116C, in response to the user's variable control of the knob 135.

In some embodiments, the throttle control feature may be used in combination with the launch control feature. For example, the amount of torque limiting may be set to match the traction conditions between the model vehicle and the road surface to substantially prevent breaking traction and spinning the wheels when the user engages the launch setting on the switch 131. In high-traction conditions, a user may use a relatively lower torque limiting setting, meaning that higher torque is available to be applied. It will be understood by persons of ordinary skill that the throttle control feature may used with other types of model vehicles, in addition to drag car style model vehicles and with the model vehicles operating in other modes, where it may be suitable or desired to limit the available torque supplied by a motor.

It is understood that multiple embodiments can take many forms and designs. Accordingly, several variations of the present design may be made without departing from the scope of this disclosure. Having thus described specific embodiments, it is noted that the embodiments disclosed are illustrative rather than limiting in nature and that a wide range of variations, modifications, changes, and substitutions are contemplated in the foregoing disclosure and, in some instances, some features may be employed without a corresponding use of the other features. Many such variations and modifications may be considered desirable by those skilled in the art based upon a review of the foregoing description of embodiments. Accordingly, it is appropriate that the appended claims be construed broadly and in a manner consistent with the scope of these embodiments.

We claim:

1. A system for controlling a remote controlled model vehicle, the system comprising:

a propulsion member for applying a moving force to the remote controlled model vehicle;

an electric motor for actuating the propulsion member in relation to electrical power supplied to the electric motor;

an electronic control device, configured to control the electrical power supplied to the electric motor; and wherein the electronic control device comprises at least a first mode of operation and a second mode of operation for controlling the electrical power; and wherein the first mode of operation comprises an open loop control of the electric motor and either, (i) a variation of the speed of advancement of the electric motor in response to receipt by the electronic control device of a command to vary electric motor speed or (ii) a variation of torque output of the electric motor in response to receipt by the electronic control device of a command to vary electric motor speed; relative to the second mode of operation.

2. The system of claim 1, wherein the electric motor is rotationally coupled to the propulsion member and the electric power supplied to the electric motor rotationally advances the electric motor incrementally in fractions of a revolution in the first mode of operation.

3. The system of claim 1, wherein the electric power is supplied to the electric motor in intervals of time to incrementally advance the electric motor in the first mode of operation.

4. The system of claim 3, wherein the time interval between supply of the electric power is varied to vary the rate of the incremental advance of the electric motor.

5. The system of claim 4, wherein a rotor of the electric motor advances in the incremental rotations by a continued sequence of commutations of stationary coils in a first group, second group, and third group of the stationary coils.

6. The system of claim 5, wherein the rotor rotates in increments of thirty degrees through a range of motion of three hundred and sixty degrees.

7. The system of claim 6, wherein the electric motor comprises a sensorless brushless DC motor with three stator phases and the rotor comprises 2 or 4 rotor poles.

8. The system of claim 1, wherein the first mode of operation further comprises limiting the range of electric motor torque, in response to the command from a remote transmitter controller.

9. The system of claim 8, wherein the electronic control device is adjustable remotely from the transmitter controller to vary the range of torque limitation output by the electric motor.

10. The system of claim 1, wherein the first mode of operation further comprises limiting electrical current supplied to the electric motor, in response to the command from a remote transmitter controller.

11. The system of claim 10, wherein the first mode of operation further comprises supplying a varying amount of voltage supplied to the electric motor, in response to the command from the remote transmitter controller.

12. The system of claim 1, further comprising a remote transmitter controller having a control member for initiating transmission of a control to switch the electronic control device between the first and second modes of operation or to adjust the first and second modes of operation, the control member comprising a button, a switch, throttle control, wheel, knob or trigger operably coupled to the transmitter controller.

13. A system for controlling a remote controlled model vehicle, the system comprising:

a propulsion member for applying a moving force to the remote controlled model vehicle;

an electric motor for actuating the propulsion member in relation to electrical power supplied to the electric motor;

an electronic control device, configured to control the electrical power supplied to the electric motor; and wherein the electronic control device comprises at least a first mode of operation and a second mode of operation for controlling the electrical power; and wherein the first mode of operation comprises an open loop control of the electric motor and a variation of the speed of advancement of the electric motor in response to receipt by the electronic control device of a command to vary electric motor speed, relative to the second mode of operation.

14. The system of claim 13, wherein the first mode of operation further comprises limiting the range of electric motor torque, in response to the command from a remote transmitter controller.

15. The system of claim 13, wherein the first mode of operation further comprises limiting electrical current supplied to the electric motor, in response to the command from a remote transmitter controller.

16. The system of claim 15, wherein the first mode of operation further comprises supplying a varying amount of voltage supplied to the electric motor, in response to the command from the remote transmitter controller.

17. A system for controlling a remote controlled model vehicle, the system comprising:

a propulsion member for applying a moving force to the remote controlled model vehicle;

an electric motor for actuating the propulsion member in relation to electrical power supplied to the electric motor;

an electronic control device, configured to control the electrical power supplied to the electric motor; and wherein the electronic control device comprises at least a first mode of operation and a second mode of operation for controlling the electrical power; and wherein the first mode of operation comprises an open loop control of the electric motor and a variation of torque output of the electric motor in response to receipt by the electronic control device of a command to vary electric motor speed, relative to the second mode of operation.

18. The system of claim 17, wherein the first mode of operation further comprises limiting the range of electric motor torque, in response to the command from a remote transmitter controller.

19. The system of claim 17, wherein the first mode of operation further comprises limiting electrical current supplied to the electric motor, in response to the command from a remote transmitter controller.

* * * * *